United States Patent [19]

Walling et al.

[11] 4,073,265

[45] Feb. 14, 1978

[54] ELECTROSTATIC POWDER COATING APPARATUS

[75] Inventors: Jorg-Hein Walling, St. Hubert; John Alan Jukes, Pierrefonds, both of Canada

[73] Assignee: Northern Telecom Limited, Montreal, Canada

[21] Appl. No.: 677,222

[22] Filed: Apr. 15, 1976

[51] Int. Cl.[2] ..... B05B 5/02

[52] U.S. Cl. ..... 118/634; 118/DIG. 5; 118/629; 118/309; 118/326; 427/25; 427/185

[58] Field of Search ..... 118/634, 629, 630, 627, 118/631, 610, DIG. 5, 309, 326; 427/25, 32, 185

[56] References Cited

U.S. PATENT DOCUMENTS

| | | | |
|---|---|---|---|
| 3,537,426 | 11/1970 | Spiller et al. | 427/185 X |
| 3,567,485 | 3/1971 | Lemelson | 427/185 |
| 3,599,603 | 8/1971 | Koch | 118/629 |
| 3,741,155 | 6/1973 | Hunder | 118/326 X |
| 3,871,328 | 3/1975 | English | 118/630 X |
| 3,921,576 | 1/1974 | Vertue | 118/634 |

*Primary Examiner*—Mervin Stein

[57] ABSTRACT

An apparatus for collecting powder exhausted from an electrostatic fluidized bed coater, in which exhaust air passes from the cloud chamber of the coater into an inner exhaust chamber and then passes through a porous plate to an outer exhaust chamber, the powder carried by the exhaust air being stopped by the porous plate and thereafter collected from the inner chamber.

5 Claims, 3 Drawing Figures

ELECTROSTATIC POWDER COATING APPARATUS

This invention relates to the coating of continuous or discrete objects with powder.

Electrostatic fluidized bed coaters are presently used to deposit powder on items such as continuously moving strands in the manufacture of insulated wire conductors in which the powder is subsequently fused by heating to form the insulation. In such a coater a fluidized bed of particulate material provides a cloud of electrostatically charged particles which electrostatically adhere to the item as it passes through the chamber of the coater. The particles are lifted by an ionized air stream which passes through a porous plate below the fluidized bed. This fluidizing air stream, entering the cloud chamber under pressure, is exhausted through a duct together with a fairly large amount of powder which is carried by the air stream into the duct because of the higher velocity of the air in the area of the duct. This powder creates a hazard and the amount present in the exhausted air must be kept below the explosion threshold.

It is an object of the present invention to provide an improved means for collecting powder carried by the exhaust air from an electrostatic fluidized bed coater.

In its broadest aspect the invention consists of an electrostatic fluidized bed coater having a housing enclosing a cloud chamber, in which a cover encloses at least the upper portion of the housing and is spaced from the housing, with a porous plate spaced from the outer cover and from the housing to provide an outer chamber and an inner chamber respectively. Apertures in the upper portion of the housing open from the cloud chamber into the inner chamber. Means are provided to draw air from the outer chamber and to collect powder from the inner chamber.

An example embodiment of the invention is shown in the accompanying drawings in which.

Figure 1:
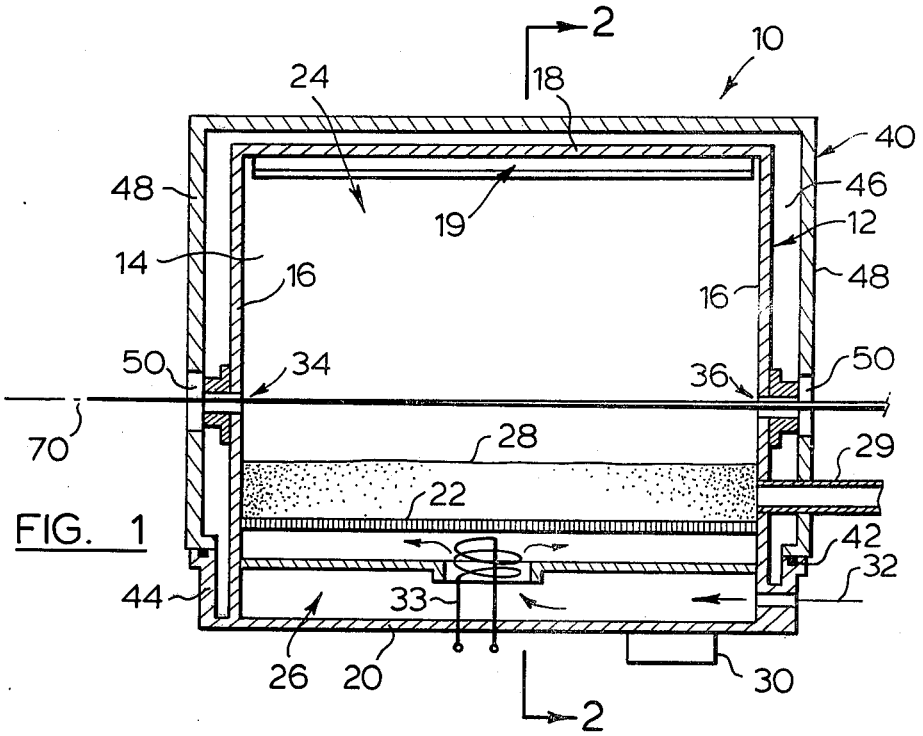
FIG. 1 is a cross-sectional side view in elevation of an electrostatic coater for powder coating continuous wire strands.

The example embodiment consists of an electrostatic coater 10 comprising a housing 12 having a pair of opposed side walls 14, a pair of opposed end walls 16, a top 18, and a bottom 20. Top 18 is separated from each side wall 14 by a slot 19 running substantially the entire length of the side wall. A porous floor plate 22 divides housing 12 into an upper or cloud chamber 24 and a lower or plenum chamber 26. A bed 28 of powder is located above porous floor plate 22, fed by an inlet conduit 29. The powder of bed 28 is fluidized by the movement of housing 12 which is agitated by a vibrator 30 and by an air stream, indicated by arrows 32, which is ionized by passing over a direct current electrode 33 using high voltage maintained at a suitable potential. The powder particles are lifted from bed 28 by the air stream. Axially aligned apertures 34 and 36 are located in opposed end walls 16 of housing 12 above fluidized bed 28.

Housing 12 is enclosed by a cover 40 which rests on a seal 42 of an upstanding flange 44 integral with bottom 20 of the housing. Cover 40 consists of a pair of opposed side walls 46 and a pair of opposed end walls 48. Apertures 50 in end walls 48 are aligned with apertures 34 and 36 in housing 12. A porous wall plate 52 is mounted within cover 40 parallel to each side wall 46. Each wall plate 52 is spaced from adjacent side wall 14 of housing 12 to provide an inner exhaust chamber 54 and from adjacent side wall 46 of cover 40 to provide an outer exhaust chamber 56. A first exhaust conduit 58 leads from each inner exhaust chamber 54 through flange 44 of housing 12 and a second exhaust conduit 60 leads from each outer exhaust chamber 56 through side wall 46 of cover 40. Porous wall plates 52 are similar to porous floor plate 22 separating cloud chamber 24 from plenum chamber 26, i.e. the wall plates allow air to pass through them but blocks the passage of any particulate matter. Cloud chamber 24 and inner exhaust chambers 54 are interconnected by slots 19 between side walls 14 and top 18 of housing 12.

Figure 2:
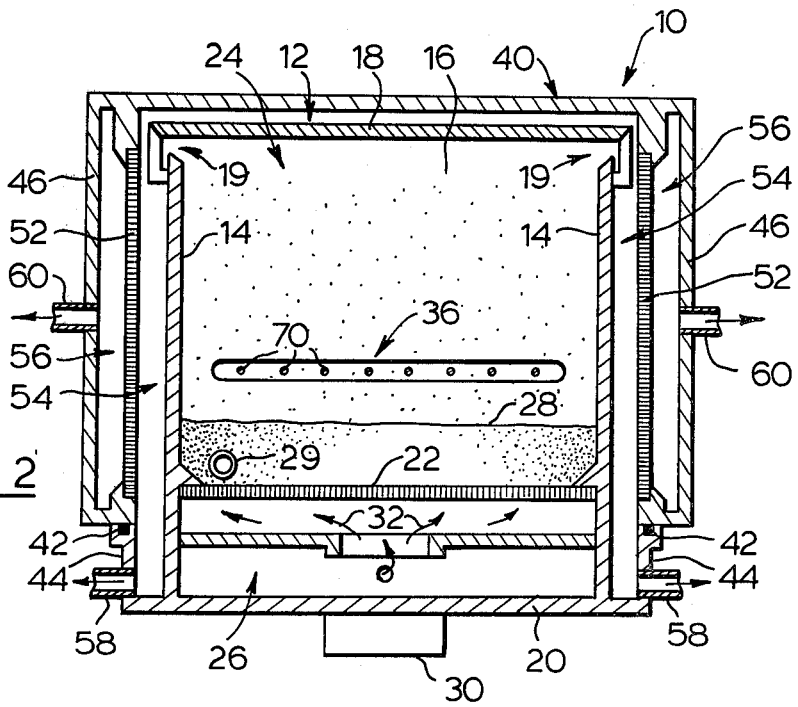
FIG. 2 is a cross-sectional view taken along line 2—2 of FIG. 1.

In the operation of the example embodiment of FIGS. 1 and 2 of the drawings a plurality of spaced parallel conductors 70 are passed simultaneously through cloud chamber 24 of electrostatic coater 10, entering the cloud chamber through aperture 34 and leaving through aperture 36. Conductors 70 are grounded through the reels from which they are fed and as the conductors pass through cloud chamber 24 the ionized particles of powder within the chamber adhere to them, forming a coating which can subsequently be fused by heat.

To maintain a cloud of the powder above bed 28, a constant air stream must be introduced, as indicated by arrows 32, and this air must be continuously exhausted to maintain the flow. In the example embodiment the air passes from cloud chamber 24 through slot 19 along each side wall 14 and into inner exhaust chamber 54 (for convenience the operation of only one side of coater 10 will be described). From inner exhaust chamber 54 the air then passes through porous wall plate 52 into outer exhaust chamber 56 and then into second exhaust conduit 60. The air emanating from cloud chamber 24 carries particles of powder which cannot pass through porous wall plate 52 and consequently adhere to the inner face of the wall plate or drop to the bottom of inner exhaust chamber 52. When powder has built up excessively on porous wall plate 52 it is removed by suitable means and then drawn through second exhaust conduit 58 for re-use.

Figure 3:
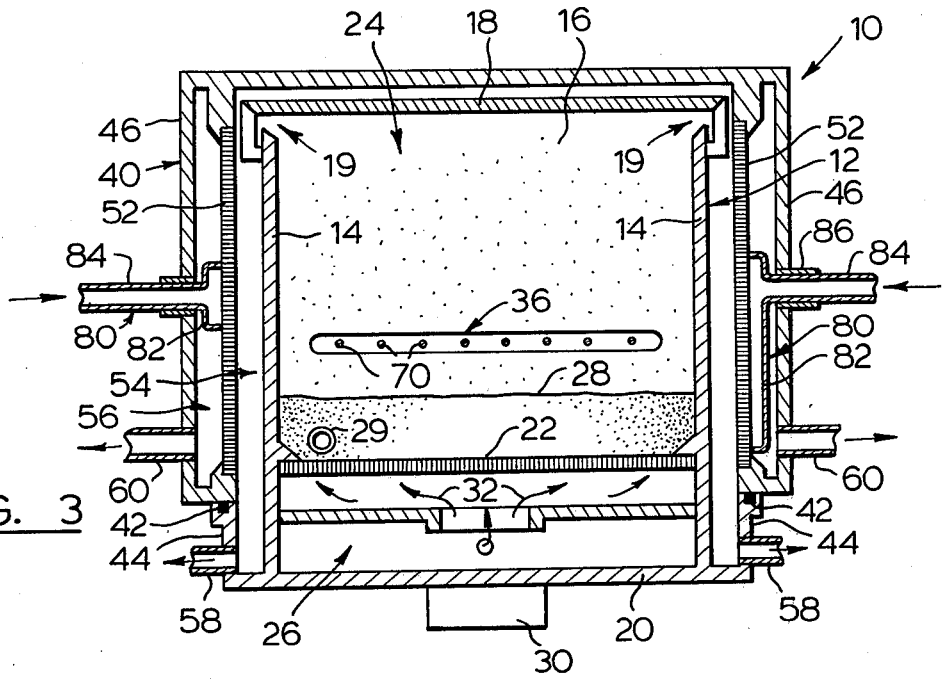
FIG. 3 is a partial cross-sectional side view in elevation similar to FIG. 1 showing an alternate embodiment of the invention.

One means of removing the powder from porous wall plate 52 is to decrease the pressure of the air flowing through cloud chamber 24 or to interrupt the air flow. An alternate means is shown in FIG. 3 of the drawings and consists of a rotatable air cleaner 80 located in outer exhaust chamber 56. Air cleaner 80 comprises a laterally elongated cup member 82 with the rim of the cup member bearing against porous wall plate 52. An annular stem 84 leads from the back of cup member 82 adjacent one end of the cup member and passes through a concentric annular flange 86 to an air pressure source (not shown). The axis of stem 84 intersects porous wall plate 52 centrally and that end of cup member 82 remote from stem 84 terminates adjacent the periphery of the porous plate.

To clean porous plate 52 using the embodiment shown in FIG. 3, air under pressure is introduced through stem 84 into cup 82 which is rotated about the axis of the stem. This causes cup 82 to sweep over the face of porous wall plate 52 and blow the powder from the wall plate into inner chamber 54 where it drops to the bottom of the inner chamber for collection through second exhaust conduit 58. Of course to dislodge the powder adhering to porous wall plate 52 the pressure of the air entering stem 84 must be greater than the pressure of the air flow from cloud chamber 24.

To assist in the non-adherance of powder on porous wall plate 52 that plate may carry an electrical potential opposite to that of the powder. Also, it might be considered advantageous to provide a wall plate 52 which passes very fine particulate matter, thus removing dust particles from the system. For maximum efficiency the combined areas of both porous wall plates 52 should be greater than the area of porous plate 22 below fluidized bed 28.

The term "porous plate" is intended to include any barrier which will pass a gaseous material but which will not pass particles of the coating powder. Such a barrier could be a fine screen or other filter material.

I claim:

1. In an electrostatic fluidized bed coater having a housing enclosing a plenum chamber and a cloud chamber separated from the plenum chamber by a porous floor plate:

a cover enclosing at least the upper portion of the housing and spaced therefrom;

a porous wall plate spaced from the housing and from the cover to provide an inner exhaust chamber and an outer exhaust chamber respectively;

at least one aperture in the upper portion of the housing opening from the cloud chamber into the inner exhaust chamber;

means to draw air from the outer exhaust chamber;

means to remove powder from the inner exhaust chamber; and means to pass pressurized air through the porous wall plate into the inner exhaust chamber whereby powder adhering to the wall plate is removed therefrom;

the means to pass pressurized air into the inner exhaust chamber comprising an elongated cup member located in the outer exhaust chamber and bearing against the porous wall plate, the cup member being movable over the face of the wall plate, and means to introduce pressurized air into the cup member.

2. A coater as claimed in claim 1 in which the porous wall plate carries an electrical potential opposite to the charge carried by the powder emanating from the cloud chamber.

3. A coater as claimed in claim 1 in which a pair of porous wall plates are spaced from the housing one on each side thereof.

4. A coater as claimed in claim 3 in which the combined areas of said pair of wall plates is larger in area than the porous floor plate.

5. An electrostatic fluidized bed coater comprising:

a rectangular housing having opposed side walls, opposed end walls, a top, a plenum chamber and a cloud chamber separated from the plenum chamber by a porous floor plate;

a rectangular cover enclosing the housing and spaced therefrom, the cover having opposed side walls and opposed end walls;

a vertical porous wall plate spaced from each side wall of the housing and from each side wall of the cover to provide an inner exhaust chamber and an outer exhaust chamber respectively;

the top of the housing being spaced from the side walls thereof to provide slots interconnecting the cloud chamber and the inner exhaust chamber;

means to draw air from the outer exhaust chamber; and means to remove powder from the bottom of the inner exhaust chamber.

* * * * *